US011332996B2

(12) United States Patent
Pendleton

(10) Patent No.: US 11,332,996 B2
(45) Date of Patent: May 17, 2022

(54) BOREHOLE JUNCTION SUPPORT BY CONSOLIDATION OF FORMATION MATERIALS

(71) Applicant: Bryan Pendleton, Cypress, TX (US)

(72) Inventor: Bryan Pendleton, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/867,944

(22) Filed: May 6, 2020

(65) Prior Publication Data

US 2021/0348472 A1 Nov. 11, 2021

(51) Int. Cl.

| | |
|---|---|
| ***E21B 41/00*** | (2006.01) |
| ***E21B 33/12*** | (2006.01) |
| ***E21B 36/00*** | (2006.01) |
| *E21B 36/04* | (2006.01) |

(52) U.S. Cl.

CPC ..... *E21B 33/12* (2013.01); *E21B 36/006* (2013.01); *E21B 41/0042* (2013.01); *E21B 36/008* (2013.01); *E21B 36/04* (2013.01)

(58) Field of Classification Search

None

See application file for complete search history.

(56) References Cited

U.S. PATENT DOCUMENTS

| | | | | |
|---|---|---|---|---|
| 5,477,925 | A * | 12/1995 | Trahan | E21B 33/14 166/117.5 |
| 6,523,610 | B1 * | 2/2003 | Griffith | E21B 29/02 166/223 |
| 2003/0132224 | A1 * | 7/2003 | Spencer | E21B 33/138 219/635 |
| 2016/0319633 | A1 | 11/2016 | Cooper et al. | |
| 2018/0274333 | A1 * | 9/2018 | Gibb | E21B 33/1208 |

FOREIGN PATENT DOCUMENTS

| | | | |
|---|---|---|---|
| EP | 1395732 | B1 | 8/2005 |
| WO | 2018175867 | A1 | 9/2018 |

OTHER PUBLICATIONS

International Search Report for International Application No. PCT/US2021/030852; dated May 5, 2021; Aug. 17, 2021; 4 pages.

Written Opinion of the International Searching Authority for International Application No. PCT/US2021/030852 dated May 5, 2021; Aug. 17, 2021; 4 pages.

* cited by examiner

*Primary Examiner* — Andrew Sue-Ako

(74) *Attorney, Agent, or Firm* — Cantor Colburn LLP

(57) ABSTRACT

A system for supporting a borehole junction includes a device configured to deploy a material in a solid state to a downhole location proximate to the borehole junction, and a heat source configured to apply heat to the material to a temperature sufficient to liquefy the material. The liquified material is configured to flow into a formation region adjacent to the borehole junction and consolidate the formation region.

18 Claims, 4 Drawing Sheets

BOREHOLE JUNCTION SUPPORT BY CONSOLIDATION OF FORMATION MATERIALS

BACKGROUND

In the resource recovery industry, the drilling of lateral boreholes from a primary borehole is increasingly utilized to increase production from resource bearing formations. Each lateral borehole extends from a primary or main borehole at a junction, which may be configured as a multilateral junction. The junction may be left unsupported, or varying levels of mechanical support can be deployed to maintain the junction. In formations that have poor consolidation, the junction can be eroded during production, which can result in sand entering the lateral and/or primary borehole.

SUMMARY

An embodiment of a system for supporting a borehole junction includes a device configured to deploy a material in a solid state to a downhole location proximate to the borehole junction, and a heat source configured to apply heat to the material to a temperature sufficient to liquefy the material. The liquified material is configured to flow into a formation region adjacent to the borehole junction and consolidate the formation region.

An embodiment of a method of supporting a borehole junction includes deploying a material in a solid state to a location proximate to the borehole junction, applying heat from a heat source to the material to a temperature sufficient to liquefy the material, the liquified material configured to flow into a formation region adjacent to the borehole junction, and removing the heat from the material so that the material solidifies in the formation region and consolidates the formation region.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed systems and methods are presented herein by way of exemplification and not limitation with reference to the Figures.

Methods, systems and devices are provided herein for consolidating a formation region proximate to a borehole junction and/or otherwise facilitating the construction and/or support of a borehole junction. An embodiment of a method of forming and/or supporting a borehole junction includes deploying a material, such as a Bismuth material, to a borehole junction. The bismuth or other material is deployed in a solid state and converted to a fluid state at the borehole junction by applying heat to liquefy the material. Solid material may be deployed in a variety of ways, such as by pumping a fluid (e.g., drilling mud) including solid material (e.g., as pellets or flakes) from the surface and/or by deploying a solid body of material with a downhole component.

For example, Bismuth material in solid form (e.g., as pellets) can be pumped downhole, or solid sleeves or layers of solid Bismuth material (e.g., elemental Bismuth or an alloy) can be attached to borehole casing and/or a liner or other component that is disposed within or extends through the junction.

Once sufficient heat has been supplied, liquid Bismuth material is allowed to flow into formation materials, and heat is removed to allow the Bismuth material to solidify and consolidate the formation region. For example, the liquid Bismuth material flows into pores and other spaces in the formation region and thereby acts to consolidate the formation to prevent ingress of fluids, sands or other unwanted materials into the borehole from the formation.

Embodiments described herein provide a number of advantages. For example, embodiments provide a way to cost-effectively prevent sand and other particulates from entering a borehole, junction and/or lateral. Embodiments can effectively consolidate a formation around a junction without requiring the inclusion of additional support structures or materials. For example, current techniques for supporting a junction to overcome unconsolidated formation issues include installing a TAML level 5 or level 6 system, which is often complex and costly. Embodiments described herein can be used to complete or support a junction without requiring such complex systems.

Figure 1:
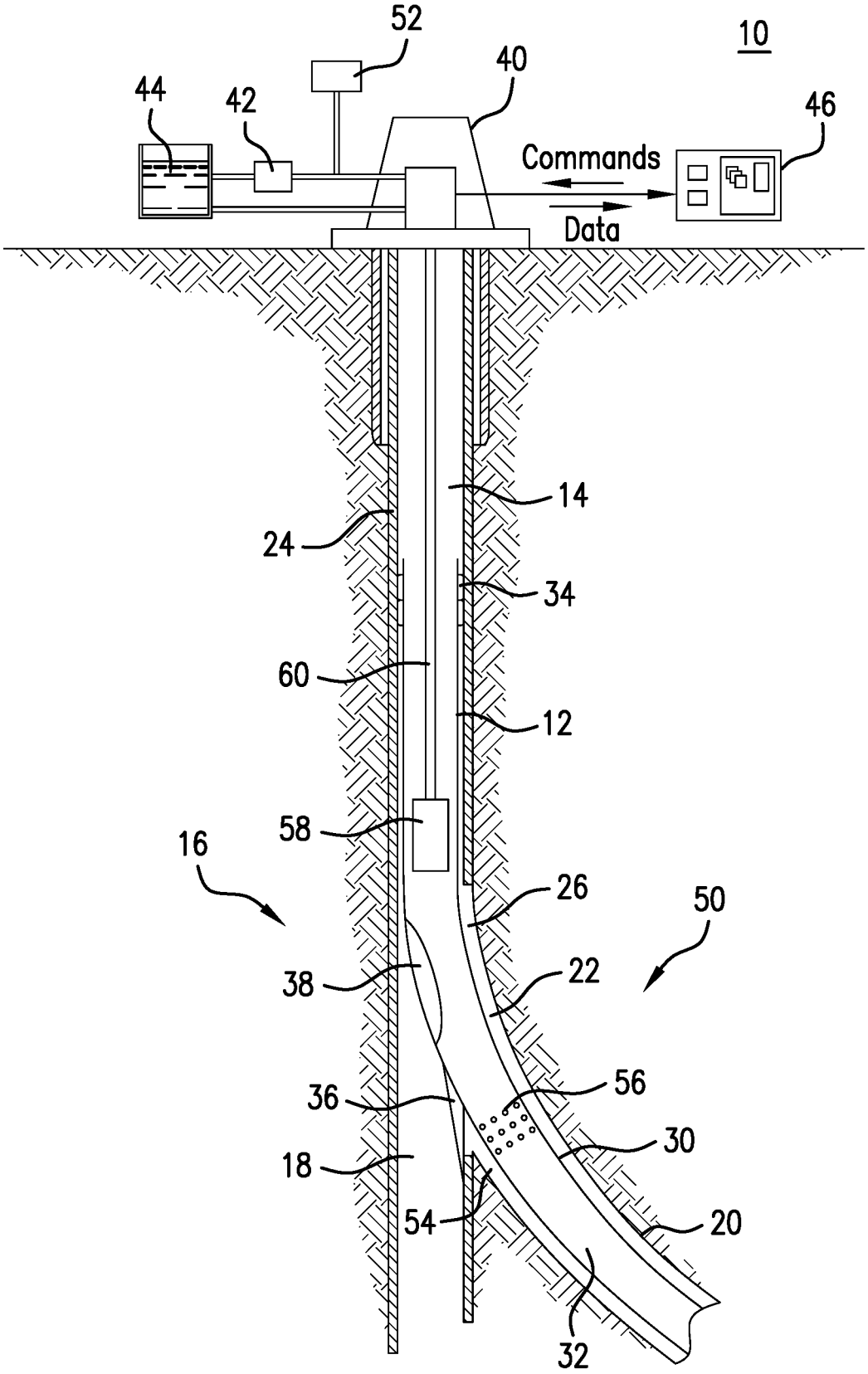
FIG. 1 depicts an embodiment of a system for performing one or more downhole operations, the system including a borehole junction support system configured to apply a Bismuth material or other suitable material to a borehole junction.

Referring to FIG. 1, an embodiment of a well drilling (and/or milling) system 10 includes a borehole string 12 that is shown disposed in a well or pilot borehole 14 that penetrates at least one resource bearing (or potentially resource bearing) formation 16 during a drilling, milling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14.

The borehole 14 includes a pilot or main borehole 18 and at least one lateral borehole 20 (or simply a lateral 20) that extends laterally away from the main borehole 18 at a borehole junction 22. In the embodiment shown in FIG. 1, the junction 22 connects a single lateral 20 to the main borehole 18, but is not so limited. The junction 22 may connect a plurality of laterals that extend therefrom, thereby forming a multilateral junction. In addition, there may be any number of junctions 22 along the main borehole 18. Each junction 22 may be a single lateral junction or a multilateral junction.

The main borehole 18 (or a length thereof) may be an open hole or a cased hole. For example, the main borehole 18 includes a length of casing 24, and the lateral 20 is drilled through a window 26 in the casing 24.

Various components may be deployed downhole for supporting the junction 22. For example, the junction 22 may be unsupported, or one or more components are disposed at the lateral junction 22 to support the junction 22. In one embodiment, the lateral junction 22 is configured according to a category of junction support systems as defined by the Technology Advancement of Multilaterals (TAML). These categories include a TAML level 1 junction, which includes an open hole main borehole and an open hole lateral. An unsupported liner or screen may be disposed in the lateral. A TAML level 2 junction uses a cased and cemented main borehole and an open hole lateral. In a TAML level 3 junction, the main borehole is cased and cemented, and the lateral is uncased but includes a mechanical support. TAML level 4 and 5 junctions feature a cased and cemented main borehole with a cased and cemented lateral.

The lateral junction 22 shown in FIG. 1 is a TAML level 3 junction, although it is noted that the junction 22 is not so limited. In the embodiment of FIG. 1, the borehole string 12 includes a junction completion 30 having a liner 32 that extends through a length of the main borehole 18 and into the lateral 20. The liner 32 is secured to the casing 24 via an anchor 34 (e.g., radially extendable dogs). The liner 32 includes a hook hanger 36 that allows the liner 32 to be supported by the casing 24 below the window 26. A liner opening 38 provides fluid communication between the surface and the main borehole 18 below the junction 22.

A surface structure or surface equipment includes or is connected to various components such as a drill rig 40. The drill rig 40 may include a wellhead, derrick and/or rotary table for performing various functions, such as deploying the borehole string 12 and other components into the borehole 14, rotating the borehole string 12, circulating fluid, communicating with downhole components, performing surface measurements and/or performing downhole measurements. The borehole string 12 is not limited to the embodiment of FIG. 1, and may be constituted of different components, such as drill pipe, wireline, wired pipe or coiled tubing.

The system 10 also includes components to facilitate circulating fluid such as drilling mud through the borehole string 12. The components also allow for control of fluid flow rate and/or pressure through the support string for facilitating operations such as drilling, deploying the borehole string 12. For example, a pumping device 42 is located at the surface to circulate fluid from a mud pit or other fluid source 44 into the borehole 14 and control fluid flow and/or pressure to realize various functions and methods described herein.

In one embodiment, one or more downhole components and/or one or more surface components are in communication with and/or controlled by a processor such as a surface processing unit 46 and/or a downhole processor. In one embodiment, the surface processing unit 46 is configured as a surface control unit which controls various parameters such as fluid flow parameters (e.g., pressure and flow rate), trip speed, rotary speed, weight-on-bit, and others.

The system 10 also includes a junction support system 50 for consolidating formation materials at a borehole junction, such as the junction 22. The junction support system 50 is configured to deploy a Bismuth material to a location proximate the junction 22 and heat the Bismuth material to transform the Bismuth material into a liquid state. The liquid Bismuth material is allowed to flow into interstitial spaces and/or pores in a region of the formation 16 at the junction 22.

The formation region, in one embodiment, refers to a region that at least partially surrounds and abuts the main borehole 18 and/or the lateral 20 at or near the junction 22. It is noted that a location that is "proximate" to the junction 22 is a location close enough to the junction 22 so that liquid Bismuth material can flow into the formation region or other volume of interest.

The junction support system 50 also includes a device or system configured to apply heat to the Bismuth material to raise the temperature of the Bismuth material above its melting point, to liquefy the Bismuth material. As noted above, the liquefied Bismuth material is allowed to flow into spaces in a formation region. Upon removing the heat, the liquid Bismuth material cools and solidifies, thereby consolidating the formation around the junction 22 and preventing erosion, compromise of the junction 22, sand ingress and/or other undesired conditions.

In one embodiment, the Bismuth material entirely consists of elemental Bismuth. Alternatively, or in addition, the Bismuth material may be an alloy having a selected concentration of Bismuth, in combination with other materials, such as lead, tin, cadmium, indium and/or other metals. The Bismuth material has a low melting point relative to other materials normally disposed downhole. For example, elemental Bismuth has a melting point of about 271 degrees Celsius, and various Bismuth alloys having melting points in the range of, for example, about 100 degrees C. to about 250 degrees C. It is noted that these ranges are provided for illustrative purposes, as the specific composition and melting point of Bismuth materials are not limited to the examples and embodiments described herein.

As discussed further herein, the Bismuth material may be deployed and heated in a variety of ways. For example, Bismuth can be pumped into the borehole with a fluid into an annular cavity in or near the junction 22. In another example, one or more downhole components can be made from a Bismuth material or attached to a solid body made from a Bismuth material. The Bismuth material can then be deployed with the one or more downhole components and subsequently heated to consolidate a formation region around the junction 22.

It is noted that, although embodiments described herein include Bismuth materials, they are not so limited. One or more other materials having desired melting and solidification temperatures may be used, either in place of Bismuth material or in combination with Bismuth material. As such, it is to be understood that references to Bismuth may encompass other materials having desired melting temperatures, e.g., melting temperatures above temperatures in a formation region and low enough to permit melting by deploying a heat source.

FIG. 1 depicts an embodiment of the junction support system 50 that includes components and functionality for deploying a solid Bismuth material by injecting a fluid including the Bismuth material from the surface. For example, the junction support system utilizes a source 52 of Bismuth material combined with one or more fluids, such as water and/or drilling mud. Bismuth material from the source 52 can be mixed with fluid from the fluid source 44, and the pumping device 42 or other suitable device can be used to pump the fluid mixture including the solid Bismuth material into the borehole 12. Bismuth material deployed with a fluid may take any suitable form. Examples include pellets, flakes, powders and spheres. Other examples include balls, plugs and darts that can be pumped downhole with drilling mud or other fluids.

In one embodiment, the liner 32 includes one or more perforations 56 that act as fluid ports and provide fluid communication between the liner 32 and an annular space 54 between a formation region and the liner 32 and/or the hook hanger 36. It is noted that embodiments described herein are not limited to perforations, as they can include ports, holes, valves and/or any other feature that provides fluid communication. Although not shown, a packer, plug or other component may be deployed in the liner 32 at a location in the lateral 20 to facilitate directing the Bismuth material through the perforations 56 and into the annular space 54.

After landing the hook hanger 36 and deploying the Bismuth material, a heating device 58 can be deployed through the main borehole 18 and into or near the junction 22, and activated to melt the Bismuth material. The heating device 58 may be any type of device that can be deployed downhole. Examples of such devices include electric heaters, induction heaters, chemical heaters and others. The heating device may be lowered using a running string 60, such as a cable, flow line or coiled tubing.

The Bismuth material may be deployed during an operation and/or while other components are disposed in the borehole 14. For example, the Bismuth material can be deployed before, during and/or after drilling while a drill string is deployed through the liner 32 to drill the lateral 20.

In the embodiment of FIG. 1, the Bismuth material is injected from the surface and circulated through the borehole string 12. However, the treatment system is not so limited, as the Bismuth material can be injected from any suitable location.

Figure 2:
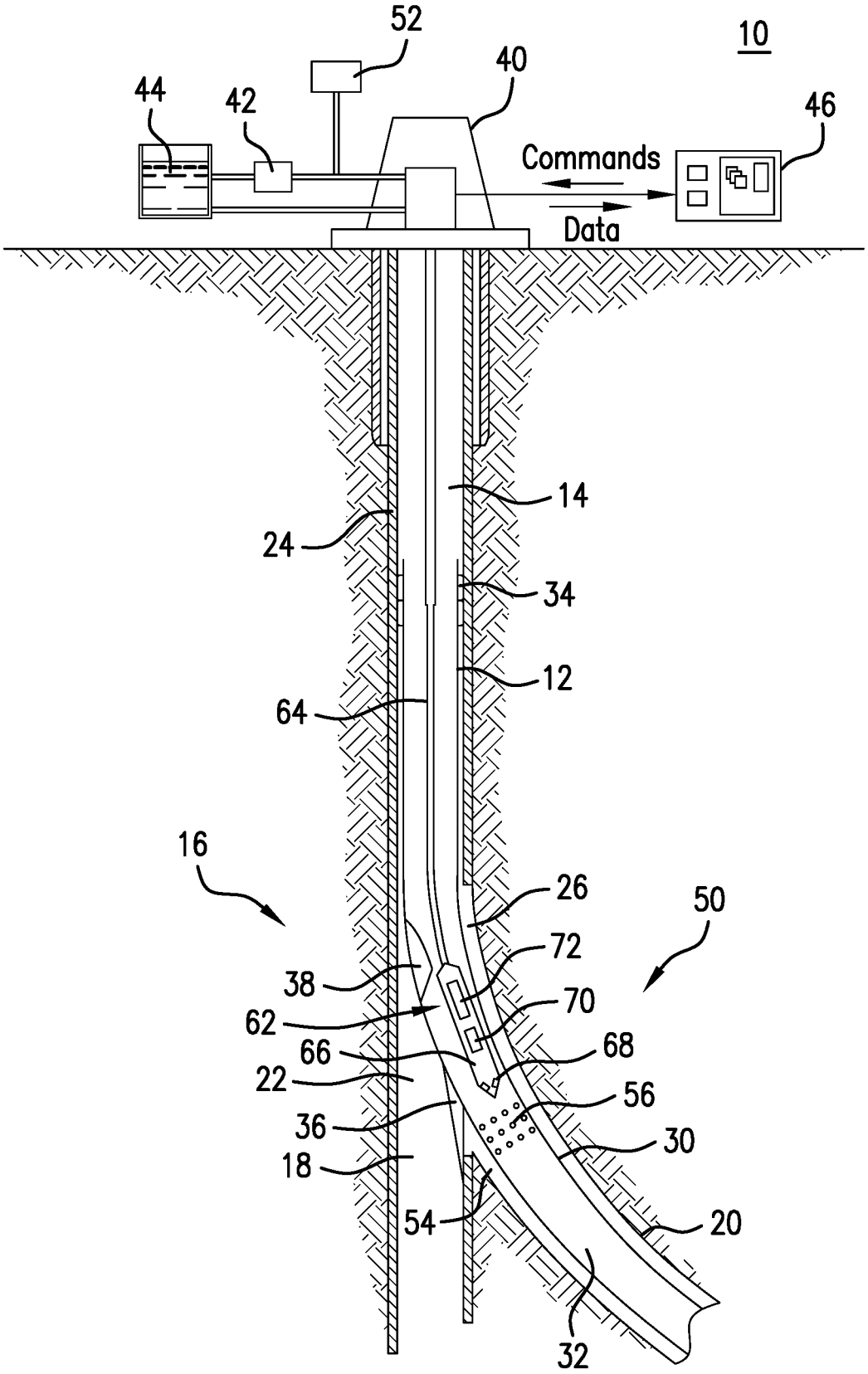
FIG. 2 depicts an embodiment of the borehole junction support system of FIG. 1, including an injection device configured to apply a fluid including solid Bismuth material to the borehole junction.

FIG. 2 depicts an embodiment of the system 10 and the junction support system 50, which includes an injection device 62 that is configured to be deployed into the junction 22. The injection device, in one embodiment, is deployed using a cable, flow line or other running string 64.

The injection device 62 includes a body 66 and one or more nozzles 68 or other outlets, through which the Bismuth material can be injected into the junction 22. The injection device 62 may be configured to receive the Bismuth material (combined with a fluid) from the surface. For example, the running string 64 includes a fluid line configured to receive a mixture of drilling mud and the Bismuth material from the source 52.

Alternatively, or in addition, the injection device 62 can include a source of Bismuth material. For example, the injection device 62 can include a storage chamber 70 in which the Bismuth material (which may or may not be combined with a fluid) is stored until injection. The injection device 62 includes any number and/or type of component to facilitate injection. For example, the injection device 62 may include one or more valves and fluid conduits. Injection can be controlled from the surface, or a controller 72 or other processing device may be included to control injection.

Figure 3:
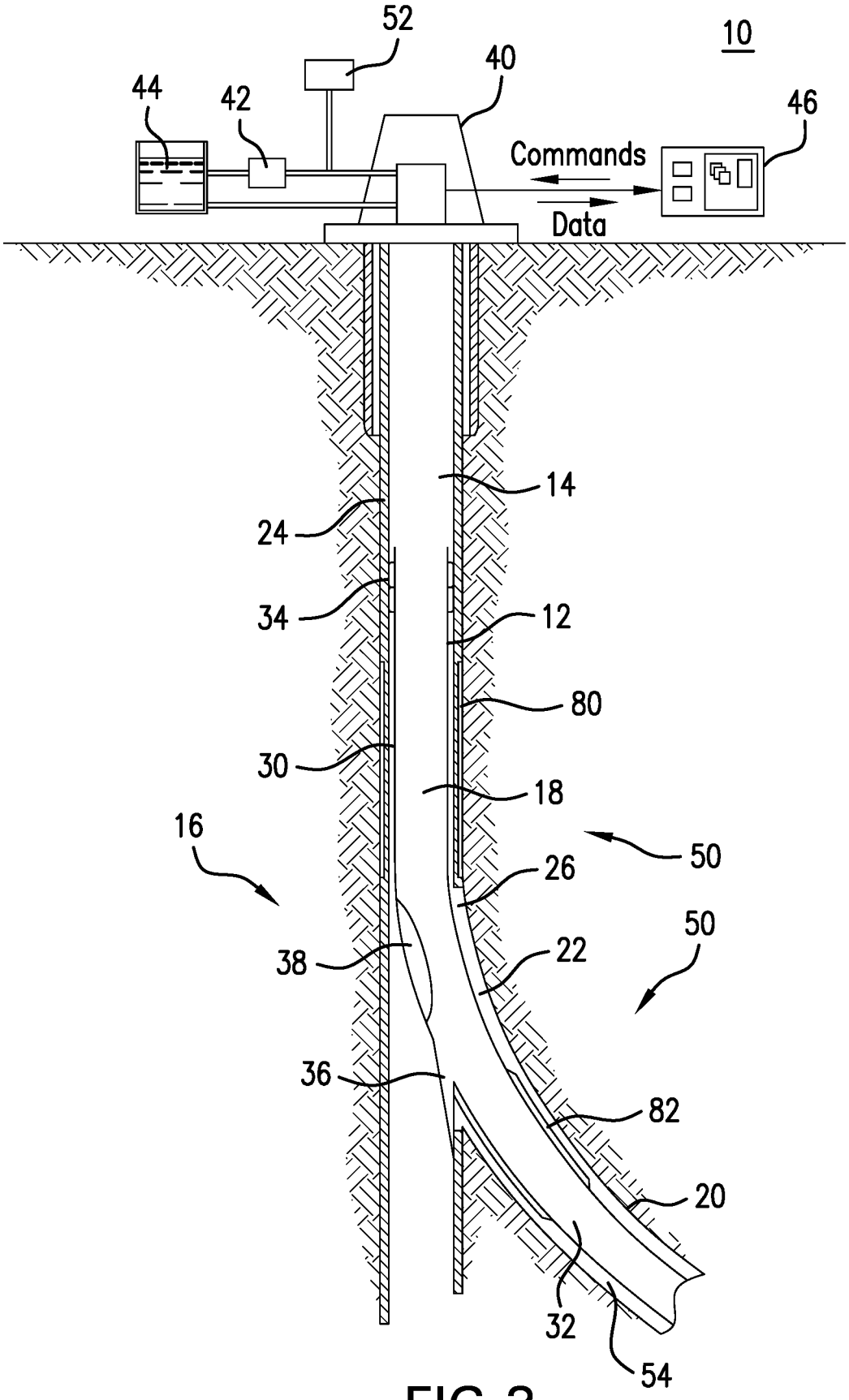
FIG. 3 depicts an embodiment of a system for performing one or more downhole operations, the system including a borehole junction support system that includes one or more solid bodies of a Bismuth material.

In one embodiment, the system 10 and the junction support system 50 includes one or more solid bodies made at least partially from the Bismuth material. For example, as shown in FIG. 3, a Bismuth layer 80 is attached to an outer surface of the casing 24. The Bismuth layer 80 may be attached as an integral portion of the casing 24 or be fixedly disposed in any manner, such as by an adhesive or mechanical fasteners.

The Bismuth layer 80 may form an entirely or partially circumferential layer and have any length and thickness selected to consolidate a length of the main borehole near the junction 22. In addition, or alternatively, a deployed component such as the liner 32 includes a partial or fully circumferential Bismuth layer 82 on an outer surface of the liner 32 at or near the junction 22.

It is noted that the one or more solid bodies of Bismuth material are not limited to those shown in FIG. 3, as they can be of any form suitable to allow for deployment as or with a downhole component. For example, a solid body or bodies of the Bismuth material may form all or part of a drill collar, sleeve, stabilizer, pipe segment, bottomhole assembly (BHA), joint, tool or other downhole component.

Referring again to FIG. 3, to consolidate a region of the formation 16, heat is applied to the Bismuth layer 80 and/or the Bismuth layer 82 after the casing 24 and/or the liner 32 is deployed and positioned as desired. The applied heat melts the Bismuth material (e.g., elemental Bismuth and/or a Bismuth alloy), and the liquid Bismuth material can then flow into a formation region or regions from annular spaces 54 through the borehole wall. The Bismuth material consolidates the region(s) after the heat is removed and the Bismuth material solidifies.

Figure 4:
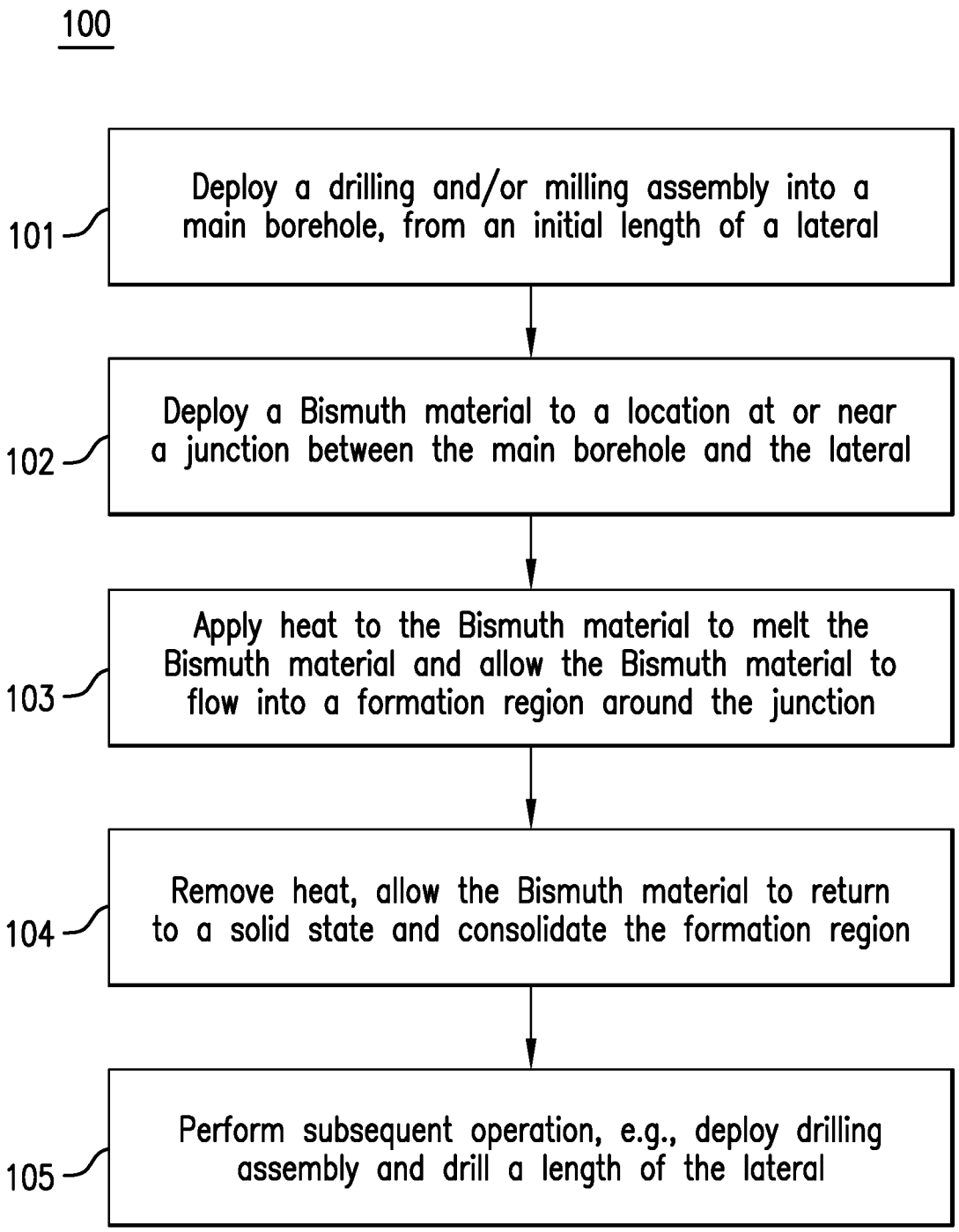
FIG. 4 is a flow chart depicting aspects of a method of supporting a borehole junction.

FIG. 4 illustrates a method 100 of consolidating or otherwise supporting a borehole junction, and/or performing aspects of an energy industry operation. The method 100 is discussed in conjunction with the embodiments of FIGS. 1-3, but is not so limited and can be used with any operation and system capable of deploying a Bismuth material downhole. Aspects of the method 100 may be performed by a processor such as the surface processing unit 46, either automatically or through input by a human operator.

The method 100 includes one or more of stages 101-105 described herein. In one embodiment, the method 100 includes the execution of all of stages 101-105 in the order described. However, certain stages 101-105 may be omitted, stages may be added, or the order of the stages changed.

In the first stage 101, a borehole junction is formed or created by drilling away from a main borehole to form an initial length of a lateral, sometimes referred to as a rat hole. If desired, a tubular such as a liner or production string can be deployed through a junction between the main borehole and the lateral.

For example, the junction 22 is created by deploying a whipstock assembly into the main borehole 18. A drilling and/or milling assembly is deployed into the main borehole 18 to cut the window 26 in casing 24. Fluid is circulated through the borehole 12 and the drilling and/or milling assembly is operated and advanced along a whipstock ramp and an initial length (rat hole) of the lateral 20 is initiated. The junction 22 may be left unsupported, or a liner (e.g., the liner 32), casing or other component is deployed to the junction 22.

In the second stage 102, a Bismuth material is deployed to a location at or near a borehole junction, such as the junction 22 or other multilateral junction. Deployment of the Bismuth material may be affected before, during or after the junction 22 is created.

The Bismuth material may be deployed in combination with one or more fluids, by pumping a fluid mixture including solid Bismuth material downhole. In addition, or alternatively, a solid body of Bismuth material, which forms or is part of a downhole component, is deployed to a location at or near a borehole junction. For example, the liner 32 having a solid Bismuth layer 82 is deployed through the junction 22.

In the third stage 103, heat is applied in any suitable manner to the Bismuth material sufficient to melt the Bismuth material. For example, a heat source such as the heating device 58 is deployed with a running string (e.g., coiled tubing string), or one or more chemicals can be pumped downhole to cause an exothermic reaction in the vicinity of the Bismuth material. As discussed above, the liquified Bismuth material flows into spaces within a formation region abutting the junction.

In the fourth stage 104, the heat is removed, and the Bismuth material is allowed to return to a solid state to consolidate and stabilize the formation region, and block sand or other materials from entering the junction.

In the fifth stage 105, other subsequent operations may be performed. such operations include, e.g., drilling, stimulation, completion and production operations. For example, a drilling assembly is subsequently used to drill a length of the lateral 20 and/or form other laterals.

Set forth below are some embodiments of the foregoing disclosure:

Embodiment 1: A system for supporting a borehole junction, the system comprising: a device configured to deploy a material in a solid state to a downhole location proximate to the borehole junction; and a heat source configured to apply heat to the material to a temperature sufficient to liquefy the material, the liquified material configured to flow into a formation region adjacent to the borehole junction and consolidate the formation region.

Embodiment 2: The system as in any prior embodiment, wherein the material is a Bismuth material having a selected concentration of Bismuth.

Embodiment 3: The system as in any prior embodiment, wherein the Bismuth material is selected from at least one of elemental Bismuth and a Bismuth alloy.

Embodiment 4: The system as in any prior embodiment, wherein the material is a Bismuth material, and the device is configured to inject a fluid including the Bismuth material in the solid state at the downhole location.

Embodiment 5: The system as in any prior embodiment, wherein the device includes an injection device configured to be deployed to the downhole location via a running string.

Embodiment 6: The system as in any prior embodiment, wherein the borehole junction includes a liner that extends through the borehole junction, the liner including one or more fluid ports providing fluid communication between an interior of the liner and an annular space between the liner and the formation region.

Embodiment 7: The system as in any prior embodiment, wherein the device includes a component configured to be deployed into a borehole, the component having a solid body of the Bismuth material attached thereto.

Embodiment 8: The system as in any prior embodiment, wherein the solid body is attached to at least one of an exterior surface of a borehole casing and an exterior surface of a liner configured to extend through the borehole junction.

Embodiment 9: The system as in any prior embodiment, wherein the borehole junction includes a liner that extends through the borehole junction, the liner includes a hook hanger, and the device is configured to deploy the material in the solid state to an annular space between the liner and the formation region.

Embodiment 10: The system as in any prior embodiment, wherein the borehole junction is a multilateral junction.

Embodiment 11: A method of supporting a borehole junction, the method comprising: deploying a material in a solid state to a location proximate to the borehole junction; applying heat from a heat source to the material to a temperature sufficient to liquefy the material, the liquified material configured to flow into a formation region adjacent to the borehole junction; and removing the heat from the material so that the material solidifies in the formation region and consolidates the formation region.

Embodiment 12: The method as in any prior embodiment, wherein the material is a Bismuth material having a selected concentration of Bismuth.

Embodiment 13: The method as in any prior embodiment, wherein the Bismuth material is selected from at least one of elemental Bismuth and a Bismuth alloy.

Embodiment 14: The method as in any prior embodiment, wherein the material is a Bismuth material, and deploying the Bismuth material includes injecting a fluid including the Bismuth material in the solid state at the downhole location.

Embodiment 15: The method as in any prior embodiment, wherein deploying the Bismuth material includes disposing an injection device into a borehole and injecting the fluid via the injection device.

Embodiment 16: The method as in any prior embodiment, wherein the borehole junction includes a liner that extends through the borehole junction, the liner including one or more fluid ports providing fluid communication between an interior of the liner and an annular space between the liner and the formation region.

Embodiment 17: The method as in any prior embodiment, wherein deploying the Bismuth material includes deploying a component having a solid body of the Bismuth material attached thereto.

Embodiment 18: The method as in any prior embodiment, wherein the solid body is attached to at least one of an exterior surface of a borehole casing and an exterior surface of a liner configured to extend through the borehole junction.

Embodiment 19: The method as in any prior embodiment, wherein the borehole junction includes a liner that extends through the borehole junction, the liner including a hook hanger, and the material is deployed in the solid state to an annular space between the liner and the formation region.

Embodiment 20: The method as in any prior embodiment, wherein the borehole junction is a multilateral junction.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for supporting a borehole junction, the system comprising:

a device configured to deploy a fluid including a first material in a solid state through a borehole to a downhole location proximate to the borehole junction;

a component configured to be deployed into the borehole, the component having a solid body of a second material attached thereto; and a heat source configured to apply heat to at least one of the first material in the solid state and the solid body of the second material to a temperature sufficient to liquefy the at least one of the first material and the second material, the liquified material configured to flow into a formation region adjacent to the borehole junction and consolidate the formation region.

2. The system of claim 1, wherein the first material is a first Bismuth material having a first selected concentration of Bismuth, and the second material is a second Bismuth material having a second selected concentration of Bismuth.

3. The system of claim 2, wherein each of first Bismuth material and the second Bismuth material is selected from at least one of elemental Bismuth and a Bismuth alloy.

4. The system of claim 1, wherein the component is selected from at least one of a borehole casing and a liner configured to extend through the borehole junction.

5. The system of claim 4, wherein the solid body includes at least one of a sleeve and a layer disposed on a surface of the component.

6. The system of claim 1, wherein the first material and the second material each include a Bismuth material.

7. The system of claim 1, wherein the solid body is attached to at least one of an exterior surface of a borehole casing and an exterior surface of a liner configured to extend through the borehole junction.

8. The system of claim 7, wherein the liner includes a hook hanger, and the device is configured to deploy the material in the solid state to an annular space between the liner and the formation region.

9. The system of claim 1, wherein the borehole junction is a multilateral junction.

10. A method of supporting a borehole junction, the method comprising:

deploying, by a device, a fluid including a first material in a solid state through a borehole to a location proximate to the borehole junction, and deploying a component into the borehole, the component having a solid body of a second material attached thereto;

applying heat from a heat source to at least one of the first material and the solid body of the second material to a temperature sufficient to liquefy the at least one of the first material and the second material, the liquified material configured to flow into a formation region adjacent to the borehole junction; and removing the heat from the liquified material so that the liquified material solidifies in the formation region and consolidates the formation region.

11. The method of claim 10, wherein the first material is a first Bismuth material having a first selected concentration of Bismuth, and the second material is a second Bismuth material having a second selected concentration of Bismuth.

12. The method of claim 11, wherein each of the first Bismuth material and the second Bismuth material is selected from at least one of elemental Bismuth and a Bismuth alloy.

13. The method of claim 10, wherein the component is selected from at least one of a borehole casing and a liner configured to extend through the borehole junction.

14. The method of claim 13, wherein the solid body includes at least one of a sleeve and a layer disposed on a surface of the component.

15. The method of claim 10, wherein the first material and the second material each include a Bismuth material.

16. The method of claim 10, wherein the solid body is attached to at least one of an exterior surface of a borehole casing and an exterior surface of a liner configured to extend through the borehole junction.

17. The method of claim 16, wherein the liner including a hook hanger, and the material is deployed in the solid state to an annular space between the liner and the formation region.

18. The method of claim 10, wherein the borehole junction is a multilateral junction.

* * * * *